US007567161B2

(12) United States Patent
Monma

(10) Patent No.: US 7,567,161 B2
(45) Date of Patent: Jul. 28, 2009

(54) COIL COMPONENT

(75) Inventor: Toshimasa Monma, Tokyo (JP)

(73) Assignee: Sumida Corporation, Tokyo (JP)

( * ) Notice: Subject to any disclaimer, the term of this patent is extended or adjusted under 35 U.S.C. 154(b) by 401 days.

(21) Appl. No.: 11/622,579

(22) Filed: Jan. 12, 2007

(65) Prior Publication Data

US 2008/0143466 A1 Jun. 19, 2008

(30) Foreign Application Priority Data

Jan. 17, 2006 (JP) ..... 2006-008990

(51) Int. Cl.
*H01F 27/02* (2006.01)

(52) U.S. Cl. ..... 336/83

(58) Field of Classification Search ..... 336/65, 336/83, 200, 212, 220–223, 232
See application file for complete search history.

(56) References Cited

U.S. PATENT DOCUMENTS 3,271,713 A * 9/1966 Oshima ..... 336/83
3,284,748 A * 11/1966 Matsumoto ..... 336/233
3,601,734 A * 8/1971 Chesney ..... 336/83
4,427,961 A 1/1984 Suzuki
4,656,450 A * 4/1987 Jarosz et al. ..... 336/83
5,307,041 A * 4/1994 Kato et al. ..... 336/83
5,751,203 A * 5/1998 Tsutsumi et al. ..... 336/65

FOREIGN PATENT DOCUMENTS

JP 58-51412 7/1983
JP 06-084649 3/1994
JP 08-222441 8/1996

* cited by examiner

*Primary Examiner*—Tuyen Nguyen
(74) *Attorney, Agent, or Firm*—Sonnenschien Nath & Rosenthal LLP

(57) ABSTRACT

A coil component having a first coil, a second coil, a third coil, each of which has a different function, an upper flange, and a lower flange, and also including a drum core in which a first winding groove having the first coil wound around is formed, and a base member having a winding shaft provided in a bottom portion, wherein a second winding groove is formed between the lower flange and the bottom portion, and the second coil and the third coil are wound around this second winding groove when the drum core and the base member are assembled together.

28 Claims, 3 Drawing Sheets

COIL COMPONENT

CROSS REFERENCES TO RELATED APPLICATIONS

The present application claims priority to Japanese Patent Application No. P2006-008990 filed on Jan. 17, 2006, which application is incorporated herein by reference to the extent permitted by law.

BACKGROUND OF THE INVENTION

1. Field of the Invention

The present invention relates to a coil component, and more particularly relates to a coil component that is mounted on an in-vehicle AM/FM radio-wave receiver.

2. Description of the Related Art

In recent years, there is an increasing requirement on design such as a size reduction, high density mounting, weight reduction and cost reduction for an electronic device in which an electronic component such as a coil component is used.

Especially, with respect to electronic devices mounted on a vehicle, a weight reduction of the whole vehicle can be realized by reducing an overall weight of each electronic device. More specifically, an improvement in vehicular power performance, a reduction in fuel consumption, and the like can be realized by making the weight of the vehicle lighter. Accordingly, there is a requirement for a similar weight reduction even to an FM/AM radio-wave receiver that is the electronic device mounted on the vehicle and an electronic component mounted thereon.

In addition, there is a need for providing an appropriate interval (working space) between adjoining coil components on a mounting substrate in order to prevent a damage during work for mounting coil components on the mounting substrate. Therefore, the number of coil components to be mounted needs to be reduced as small as possible in order to achieve the size reduction of the electronic device while satisfying the recent requirement of high density mounting at a high level.

In the past, plural coil components which are such coil components as one described in Japanese Unexamined Utility Model Publication No. S58-51412, for example, and which have mutually different functions are mounted on the mounting substrate to make the AM/FM radio-wave receiver possess plural functions such as receiving function and filtering function.

However, in case that the plural coil components having the same or similar electrical characteristic and shape are disposed on the mounting substrate, a mounting space proportional to the number of coil components as described hereinbefore needs to be secured on the mounting substrate. Accordingly, the mounting substrate becomes large when the plural coil components are used, and consequently there occurs such a problem that the weight of the electronic device is increased.

In addition, there also arises such a problem that costs of the electronic device become high due to a use of the plural coil components.

Then, in order to make one coil component possess different functions, a coil component having plural coils wound therein is known (refer to Japanese Unexamined Patent Publication No. H6-84649 and Japanese Unexamined Patent Publication No. H8-222441). It is possible to reduce the number of coil components to be mounted and to reduce the size of the mounting substrate of the electronic device by using such coil component.

SUMMARY OF THE INVENTION

However, in case that the plural coils are provided in one coil component, there arises such a problem that it is difficult to set a desired inductance value since magnetic coupling occurs in a portion where magnetic fluxes commonly pass through when the magnetic fluxes generated from respective coils pass through a magnetic material portion such as a ferrite core.

In consideration of the problem described hereinbefore, the present inventor has recognized a need for providing with a coil component having plural functions in which a disposition area of the coil component on a mounting substrate can be reduced and also the magnetic coupling can be prevented from occurring.

Such requirement is realized by embodiments of the present invention described in the following items (1) through (6).

(1) A coil component having a first coil, a second coil, a third coil, each of which has a different function, a drum core having an upper flange and a lower flange and also being formed with a first winding groove in which said first coil is wound around, and a base member having a winding shaft provided in a bottom portion, wherein a second winding groove is formed between the aforesaid lower flange and the aforesaid bottom portion, and the aforesaid second coil and the aforesaid third coil are wound around this second winding groove when the aforesaid drum core and the aforesaid base member are assembled together.

(2) A coil component described in the above item (1), in which there is the following relation, $$T1 \geqq T2 \geqq T3$$

when the number of windings in the aforesaid first coil is T1, the number of windings in the aforesaid second coil is T2, and the number of windings in the aforesaid third coil is T3.

(3) A coil component described in the above item (1) or (2), in which a pot core is disposed in a state of being screwed up in a case such that the pot core covers the aforesaid drum core.

(4) A coil component described in any one of the above items (1) to (3), in which the aforesaid pot core is relatively movable to the aforesaid case.

(5) A coil component described in the above item (3) or (4), in which a magnetic flux excited by the aforesaid first coil passes mostly through magnetic paths formed from the aforesaid drum core and the aforesaid pot core.

(6) A coil component described in any one of the above items (1) to (5), in which the aforesaid third coil is set such that an LC series resonance occurs in a frequency band of 162.400 MHz to 162.550 MHz.

In addition, according to the coil component related to the embodiment of the present invention, the magnetic coupling to be generated in the inside of the coil component can be prevented from occurring.

DESCRIPTION OF THE PREFERRED EMBODIMENTS

Preferred embodiments of coil components according to the present invention are explained hereinafter by referring to the accompanied drawings, however a coil component according to an embodiment of the present invention is not limited to the embodiments described hereinafter.

Figure 1:
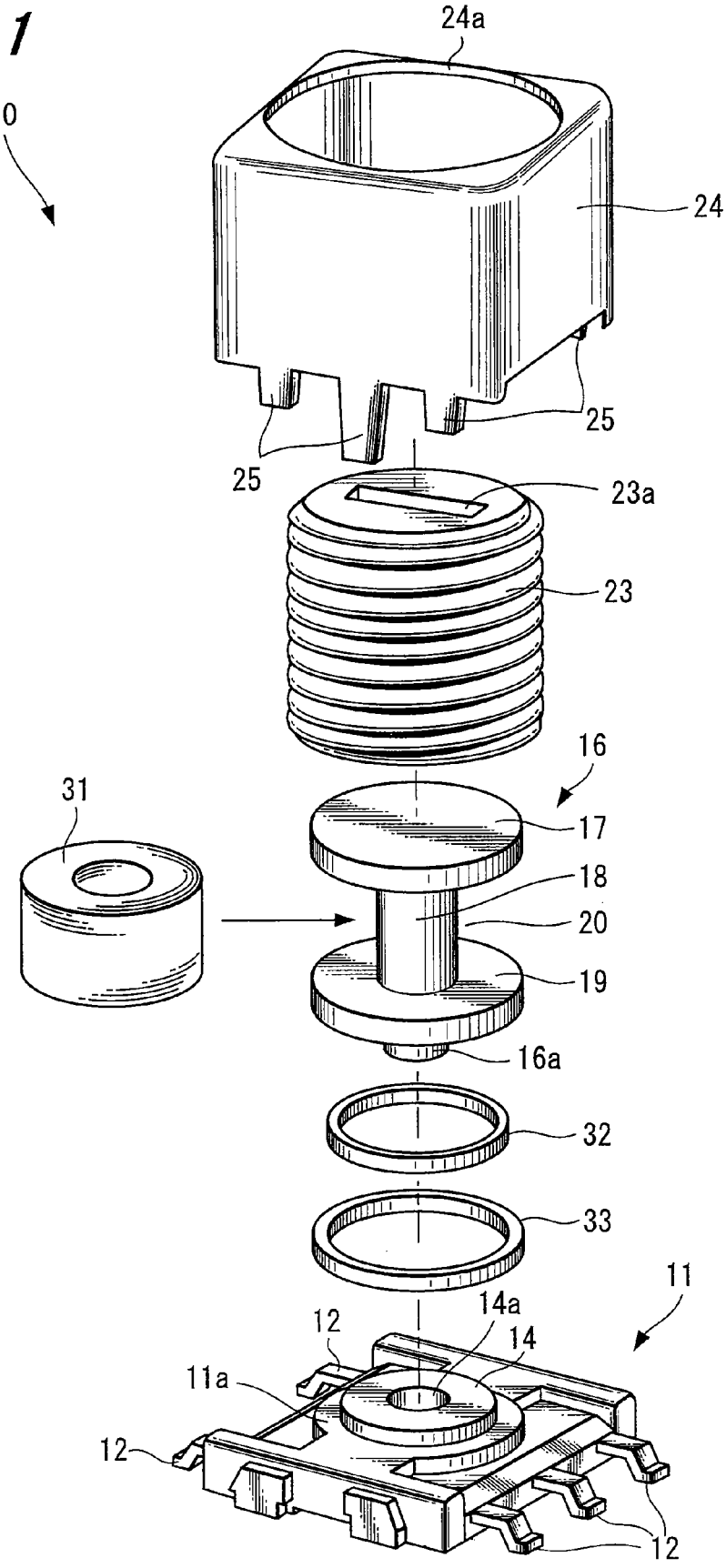
FIG. 1 is an exploded view of an AM wave loading coil component with filter according to an embodiment of the present invention.

FIG. 1 is an exploded view of an AM wave loading coil component with filter 10 according to an embodiment of the present invention.

As shown in FIG. 1, the AM wave loading coil component with filter 10 includes a base member 11, a drum core 16, pot core 23, and a case 24.

The base member 11 is formed into a rectangular shape by using synthetic resin that is a non-magnetic member and has plural terminals 12 that is drawn out to a lateral surface. The terminal 12 is made of a metal strip and is formed such that one end is buried in the base member 11 and the other end is drawn out of the lateral surface of the base member 11.

A round-shaped bottom face portion 11*a* having a planar surface on an upper portion is formed in a central part of a bottom portion of the base member 11. A cylindrical winding shaft 14 projecting upward against the planar surface is formed in a central part of this bottom face portion 11*a*. In addition, an engagement concave portion 14*a* for inserting an engagement projection 16*a* provided in the drum core 16 is formed in an inner side of the winding shaft 14.

Figure 2:
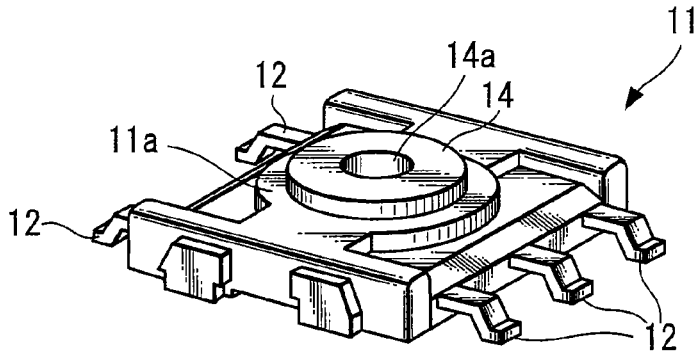
FIG. 2 is a perspective view of a base member that is used for an AM wave loading coil with filter.

FIG. 2 is a perspective view of the base member 11 that is used for the AM wave loading coil component with filter 10.

As shown in FIG. 2, the engagement concave portion 14*a* formed in the inner side of the winding shaft 14 is formed such that the engagement concave portion has a round-shaped hole to match with a shape of the engagement projection 16*a* provided in the drum core 16.

The planar surface is formed along an outer circumference of the winding shaft 14 on the bottom face portion 11*a*, and an FM wave suppression filter coil 32 of a second coil and a weather band suppression filter coil 33 of a third coil, both of which are described later, are mounted on this planar surface.

The FM wave suppression filter coil 32 of the second coil is wound around the winding shaft 14. Leads of this coil filter 32 are drawn out to a lateral side, bound round the prescribed terminals 12, and connected by using solder and the like.

Figure 5:
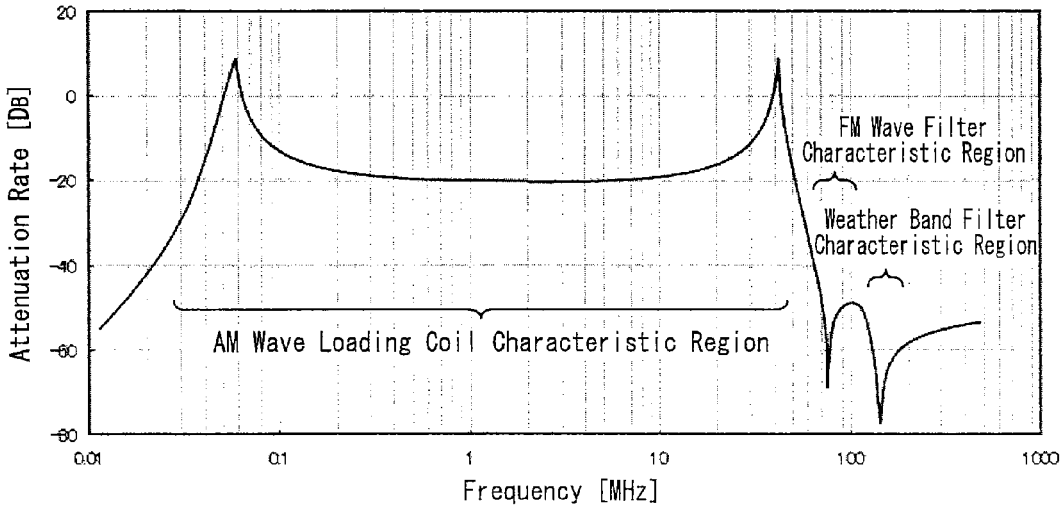
FIG. 5 is a diagram showing a relation of frequency and electric characteristic of an AM wave loading coil component with filter according to an embodiment of the present invention.

In addition, as is clear from FIG. 5 showing a relation of frequency and electric characteristic of the AM wave loading coil component with filter 10, the FM wave suppression filter coil 32 of this embodiment is set such that this filter coil has an attenuation characteristic capable of removing an FM wave in a frequency band of 76.0 MHz to 108.5 MHz. Therefore, the FM wave suppression filter coil 32 can prevent an interference of the FM wave in the coil component 10 by removing the FM wave.

Further, the weather band suppression filter coil 33 of the third coil is wound on an outer side of the FM wave suppression filter coil 32. It should be noted that leads of the weather band suppression filter coil 33 are drawn out to the lateral side from the second winding shaft 14, bound round the prescribed terminals 12, and connected by using the solder and the like.

Here, a primary use of the weather band suppression filter coil 33 is explained.

A case that an AM/FM radio-wave receiver equipped with the AM wave loading coil component with filter 10 is used in the United States, for example, is considered.

In the United States, a radio wave to deliver weather information using a frequency band of 162.400 MHz to 162.550 MHz (generally called the weather band) is transmitted in addition to the AM wave and FM wave. Therefore, AM/FM radio-wave receiver needs to have a function that prevents the interference of the weather information radio wave in such country.

As is clear from FIG. 5, the weather band suppression filter coil 33 is set such that the attenuation characteristic to be obtained from a resonant frequency $f_0$ generated by the series resonance with capacitor C (LC series resonance) becomes large in the frequency band of 162.400 MHz to 162.550 MHz. Therefore, the weather band suppression filter coil 33 can remove the radio wave of the weather information using the frequency band of 162.400 MHz to 162.550 MHz, and the interference of the weather information radio wave can be prevented in the coil component 10.

As shown in FIG. 1, the drum core 16 is formed such that an upper flange 17 and a lower flange 19 have a prescribed interval through a winding shaft 18, and a first winding groove 20 is formed in a portion of that interval. It should be noted that a width of the first winding groove 20 is formed larger than a width of a later-described second winding groove 21 since the number of windings T1 in the AM wave loading coil 31 needs to be set larger as described later.

In addition, the cylindrical engagement projection 16*a* is formed on a lower side of the lower flange 19 of the drum core 16 in a manner projecting toward the base member 11. It should be noted that the engagement projection 16*a* is arranged on a center axis line of the winding shaft 18 of the drum core 16.

When the base member 11 and the drum core 16 are assembled together, the engagement projection 16*a* of the drum core 16 made of ferrite is inserted into the engagement concave portion 14*a* of the base member 11 such that the drum core 16 is bonded and fixed to the base member 11. At that time, the drum core 16 is assembled such that the center line of the winding shaft 18 becomes vertical to the bottom face portion 11*a* of the base member 11.

Then, the AM wave loading coil 31 of the first coil is wound around the first winding groove 20 of the drum core 16. Leads of the AM wave loading coil 31 are drawn out to the lower side from the winding groove 20, bound round the prescribed terminals 12, and connected by using the solder and the like.

Here, the AM wave loading coil 31 needs to set the number of windings T1 large so that the reception sensitivity of the AM wave is increased.

More specifically, the AM wave loading coil 31 of this embodiment is made into high inductance specifications such that the AM wave can be received excellently in a frequency band of 170 KHz to 30 MHz, more precisely in LW (long wave) region: 170 KHz to 350 KHz, MW (middle wave) region: 530 KHz to 1,750 KHz, and SW (short wave) region: 4 MHz to 30 MHz, as shown in FIG. 5. In other words, the number of windings T1 in the AM wave loading coil 31 is set to be the largest in comparison to the number of windings T2 in the FM wave suppression filter coil 32 and the number of windings T3 in the weather band suppression filter coil 33.

As described hereinbefore, the AM wave loading coil 31, FM wave suppression filter coil 32 and weather band suppression filter coil 33 respectively having the different functions are included and also the relation among the number of windings T1 in the AM wave loading coil 31, the number of windings T2 in the FM wave suppression filter coil 32 and the number of windings T3 in the weather band suppression filter coil 33 is set into T1≧T2≧T3 in the AM wave loading coil component with filter 10 according to this embodiment.

Accordingly, the number of coil components to be mounted on the mounting substrate can be reduced since the configuration is set such that one AM wave loading coil component with filter 10 has the plural functions. In addition, the size of the AM/FM radio-wave receiver equipped with the coil component 10 can be reduced by reducing the size of the mounting substrate.

Furthermore, the reception accuracy of the AM wave can be maintained high by setting the number of windings T in each coil into such relation as described hereinbefore, and also the size of the coil component 10 can be reduced by reducing the size of the portion where the filter coils 32 and 33 are wound so that the size reduction can be realized to the electronic device on which the coil component 10 is mounted.

Next, the drum core 16 having the coils 31 and 32 wound thereon is covered with the pot core 23.

The pot core 23 is made of a bottomed cylindrical cup-shaped ferrite which is formed such that a lower side is open and an upper side is closed, and a circumferential side thereof is screwed up in the case 24. In addition, a minus groove 23*a* is formed in an upper portion of the pot core 23.

The case 24 is made of metal such as copper or brass, and the case 24 is attached to the base member 11 by bending case ground terminals 25 toward a bottom face of the base member 11. In addition, a circular through-hole 24*a* is formed in an upper part of the case 24.

Figure 3:
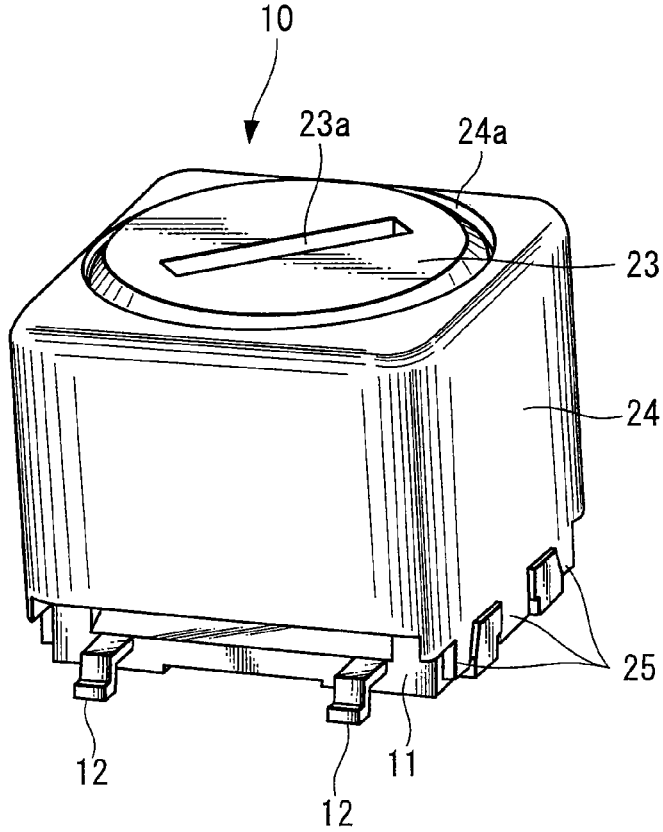
FIG. 3 is a perspective view of an AM wave loading coil component with filter according to an embodiment of the present invention.

FIG. 3 is a perspective view of the assembled AM wave loading coil component with filter 10.

As shown in FIG. 3, the AM wave loading coil component with filter 10 can visually recognize the minus groove 23*a* provided in the pot core 23 through the through-hole 24*a* of the case 24. Then, the pot core 23 can be moved to a vertical direction by turning the pot core 23 with a screw driver and the like that is inserted into the minus groove 23*a*.

The AM wave loading coil component with filter 10 is mounted on the mounting substrate by connecting the terminals 12 to a conductive pattern of a circuit board. Next, an electrical characteristic of the circuit board is checked in a state where the coil component 10 is mounted on the circuit board. Then, when the electrical characteristic is deviated from a desired preset value, the screw driver or the like is inserted into the minus groove 23*a* to move the pot core 23 relatively to the case 24, and thereby the magnetic flux passing though the inside of the pot core 23 is changed so that a miner adjustment of the electrical characteristic of the circuit board can be performed.

Figure 4:
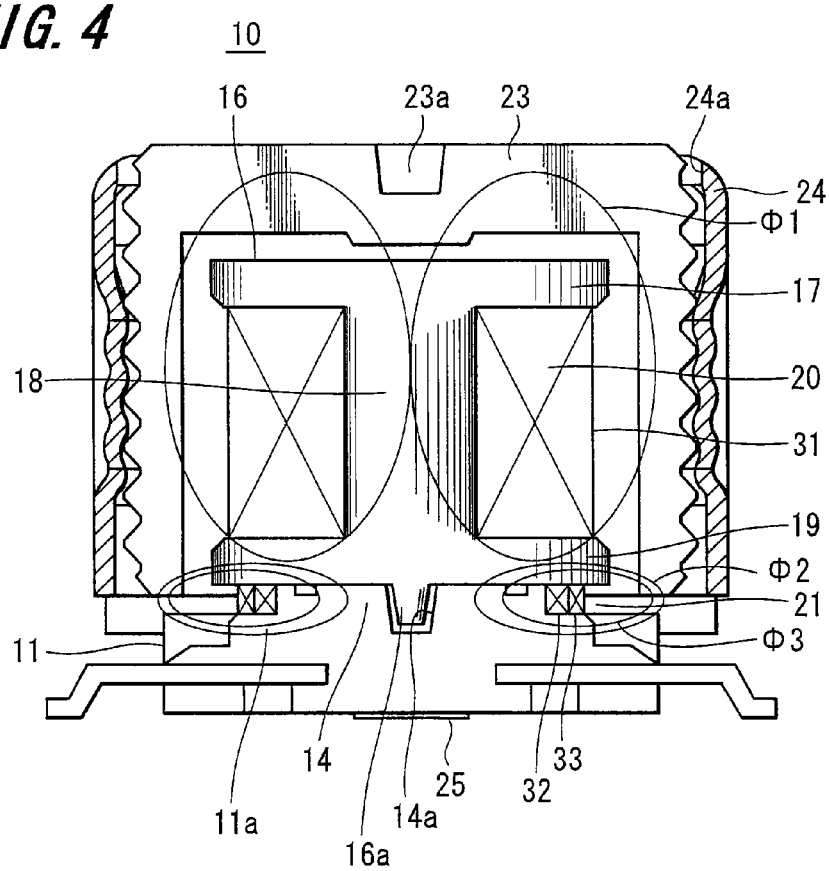
FIG. 4 is a cross-sectional view of an AM wave loading coil component with filter according to an embodiment of the present invention.

FIG. 4 is a cross-sectional view of the AM wave loading coil component with filter 10 according to this embodiment.

As shown in FIG. 4, the second winding groove 21 is formed between the bottom face of the lower flange 19 of the drum core 16 and the bottom face portion 11*a* of the based member 11 by inserting the engagement projection 16*a* formed in the lower part of the drum core 16 into the engagement concave portion 14*a* of the base member 11. Then, the FM wave suppression filter coil 32 and the weather band suppression filter coil 33 are disposed in this winding groove 21.

It should be noted that the weather band suppression filter coil 33 is disposed outside the FM wave suppression filter coil 32 in this embodiment but on the contrary thereto the FM wave suppression filter coil 32 may be disposed outside the weather band suppression filter coil 33.

As described above, according to the AM wave loading coil component with filter 10 related to this embodiment, since the winding groove 21 for winding the FM wave suppression filter coil 32 and the weather band suppression filter coil 33 can be formed in this manner by utilizing the lower flange 19 of the drum core 16 and the bottom face portion 11*a* of the base member 11, it is not necessary to form a separate winding groove on the drum core 16.

A magnetic path $\phi$1 formed by the magnetic flux generated from the AM wave loading coil 31, a magnetic path $\phi$2 formed by the magnetic flux generated from the FM wave suppression filter coil 32, and a magnetic path $\phi$3 formed by the magnetic flux generated from the weather band suppression filter coil 33 are respectively formed in the inside of the coil component 10.

The coil component 10 is configured such that the magnetic path $\phi$1 of the AM wave loading coil 31 passes through the upper flange 17 of the drum core and the pot core 23 and then passes through the winding shaft 18 of the drum core from the lower flange 19 of the drum core. More specifically, the configuration is set such that the magnetic path $\phi$1 of the AM wave loading coil 31 passes mostly through magnetic body portions. Thereby, the inductance value of the AM wave loading coil 31 required for increasing the reception sensitivity of the AM wave can be secured in the coil component 10.

The coil component 10 is configured such that the magnetic path $\phi$2 of the FM wave suppression filter coil 32 and the magnetic path $\phi$3 of the weather band suppression filter coil 33 pass through the lower flange 19 of the drum core 16 and then pass through the base member 11. Therefore, a common passage portion between the magnetic path $\phi$2 of the FM wave suppression filter coil 32 as well as the magnetic path $\phi$3 of the weather band suppression filter coil 33 and the magnetic path $\phi$1 of the AM wave loading coil 31 becomes only a part of the lower flange 19 of the drum core 16 and passage portions other than the above pass through separate routes.

Therefore, according to the AM wave loading coil component with filter 10 of this embodiment, it is possible to reduce the magnetic coupling occurring between the magnetic fluxes of the different coils in the inside of the coil component 10 since the magnetic path $\phi$1 of the AM wave loading coil 31, the magnetic path $\phi$2 of the FM wave suppression filter coil 32 and the magnetic path $\phi$3 of the weather band suppression filter coil 33 can be kept in a state of being magnetically separated and independent.

Also, the magnetic coupling can be lowered in comparison to a winding core composed of the magnetic body since the magnetic path $\phi$2 of the FM wave suppression filter coil 32 and the magnetic path $\phi$3 of the weather band suppression filter coil 33 are configured such that the most of those magnetic paths pass through the base member 11 made of a non-magnetic material.

Thus, according to the AM wave loading coil component with filter 10 of this embodiment, it is possible to prevent such a case that the desired electric characteristic value can not be obtained because of an influence of mutual inductance generated by the magnetic coupling since the coil component can be driven in a state that there is less magnetic coupling.

It should be noted that a magnetic saturation generating due to the passage of the magnetic fluxes of different coils through the magnetic body in the coil component is considered to hardly occur since the electric current to be flowed in the coils is generally small in the coil component that is mounted on a signal system circuit.

Also, according to the AM wave loading coil component with filter 10 of this embodiment, there is no necessity to change the specification of the coil component 10 depending on a situation in a country where the coil component 10 is used since the functions of the AM wave loading coil 31, FM wave filter coil 32 and weather band filter coil 33 can be incorporated into the coil of one specification.

Further, according to the AM wave loading coil component with filter 10 of this embodiment, the area of the mounting substrate can be reduced and the weight reduction of the electronic device can be achieved since it is possible to reduce the number of coil components to be used when plural functions are provided for the electronic device.

In addition, the manufacturing costs of the electronic device can be lowered since the number of coil components 10 to be mounted on the electronic device can be reduced.

It should be noted that the coil component according to an embodiment of the present invention is not limited to the above-described embodiments and it is obvious that various alterations and modifications in material, structure and the like other than those described above are possible without departing from the scope of the present invention. Especially, the shape of the screw grove provided in the upper part of the pot core is not limited to the minus shape.

Having described preferred embodiments of the invention with reference to the accompanying drawings, it is to be understood that the invention is not limited to those precise embodiment and that various changes and modifications could be effected therein by one skilled in the art without departing from the spirit or the scope of the invention as defined in the appended claims.

What is claimed is:

1. A coil component comprising a first coil, a second coil, a third coil, each of which has a different function, a drum core having an upper flange and a lower flange and also being formed with a first winding groove in which said first coil is wound around, and a base member having a winding shaft provided in a bottom portion, wherein a second winding groove is formed between said lower flange and said bottom portion, and said second coil and said third coil are wound around this second winding groove when said drum core and said base member are assembled together.

2. A coil component according to claim 1, wherein there is a relation of $$T1 \geqq T2 \geqq T3$$

when the number of windings in said first coil is T1, the number of windings in said second coil is T2, and the number of windings in said third coil is T3.

3. A coil component according to claim 1, wherein a pot core is disposed in a state of being screwed up in a case such that the pot core covers said drum core.

4. A coil component according to claim 2, wherein a pot core is disposed in a state of being screwed up in a case such that the pot core covers said drum core.

5. A coil component according to claim 1, wherein said pot core is relatively movable to said case.

6. A coil component according to claim 2, wherein said pot core is relatively movable to said case.

7. A coil component according to claim 3, wherein said pot core is relatively movable to said case.

8. A coil component according to claim 4, wherein said pot core is relatively movable to said case.

9. A coil component according to claim 3, wherein a magnetic flux excited by said first coil passes mostly through magnetic paths formed from said drum core and said pot core.

10. A coil component according to claim 4, wherein a magnetic flux excited by said first coil passes mostly through magnetic paths formed from said drum core and said pot core.

11. A coil component according to claim 5, wherein a magnetic flux excited by said first coil passes mostly through magnetic paths formed from said drum core and said pot core.

12. A coil component according to claim 6, wherein a magnetic flux excited by said first coil passes mostly through magnetic paths formed from said drum core and said pot core.

13. A coil component according to claim 7, wherein a magnetic flux excited by said first coil passes mostly through magnetic paths formed from said drum core and said pot core.

14. A coil component according to claim 8, wherein a magnetic flux excited by said first coil passes mostly through magnetic paths formed from said drum core and said pot core.

15. A coil component according to claim 1, wherein said third coil is set such that an LC series resonance occurs in a frequency band of 162.400 MHz to 162.550 MHz.

16. A coil component according to claim 2, wherein said third coil is set such that an LC series resonance occurs in a frequency band of 162.400 MHz to 162.550 MHz.

17. A coil component according to claim 3, wherein said third coil is set such that an LC series resonance occurs in a frequency band of 162.400 MHz to 162.550 MHz.

18. A coil component according to claim 4, wherein said third coil is set such that an LC series resonance occurs in a frequency band of 162.400 MHz to 162.550 MHz.

19. A coil component according to claim 5, wherein said third coil is set such that an LC series resonance occurs in a frequency band of 162.400 MHz to 162.550 MHz.

20. A coil component according to claim 6, wherein said third coil is set such that an LC series resonance occurs in a frequency band of 162.400 MHz to 162.550 MHz.

21. A coil component according to claim 7, wherein said third coil is set such that an LC series resonance occurs in a frequency band of 162.400 MHz to 162.550 MHz.

22. A coil component according to claim 8, wherein said third coil is set such that an LC series resonance occurs in a frequency band of 162.400 MHz to 162.550 MHz.

23. A coil component according to claim 9, wherein said third coil is set such that an LC series resonance occurs in a frequency band of 162.400 MHz to 162.550 MHz.

24. A coil component according to claim 10, wherein said third coil is set such that an LC series resonance occurs in a frequency band of 162.400 MHz to 162.550 MHz.

25. A coil component according to claim 11, wherein said third coil is set such that an LC series resonance occurs in a frequency band of 162.400 MHz to 162.550 MHz.

26. A coil component according to claim 12, wherein said third coil is set such that an LC series resonance occurs in a frequency band of 162.400 MHz to 162.550 MHz.

27. A coil component according to claim 13, wherein said third coil is set such that an LC series resonance occurs in a frequency band of 162.400 MHz to 162.550 MHz.

28. A coil component according to claim 14, wherein said third coil is set such that an LC series resonance occurs in a frequency band of 162.400 MHz to 162.550 MHz.

* * * * *